US009561923B2

(12) United States Patent
Tatsumi

(10) Patent No.: US 9,561,923 B2
(45) Date of Patent: Feb. 7, 2017

(54) SHEET CONVEYING DEVICE AND IMAGE FORMING APPARATUS PROVIDED WITH SAME

(71) Applicant: KYOCERA Document Solutions Inc., Osaka-shi, Osaka (JP)

(72) Inventor: Eiji Tatsumi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/877,172

(22) Filed: Oct. 7, 2015

(65) Prior Publication Data

US 2016/0107856 A1 Apr. 21, 2016

(30) Foreign Application Priority Data

Oct. 16, 2014 (JP) ..... 2014-211385

(51) Int. Cl.

| | |
|---|---|
| ***B65H 3/66*** | (2006.01) |
| ***B65H 5/36*** | (2006.01) |
| ***B65H 5/26*** | (2006.01) |
| ***B65H 9/00*** | (2006.01) |

(52) U.S. Cl.

CPC *B65H 5/26* (2013.01); *B65H 3/66* (2013.01); *B65H 5/36* (2013.01); *B65H 9/006* (2013.01); *B65H 2404/6111* (2013.01)

(58) Field of Classification Search

CPC ..... B65H 5/36; B65H 5/38; B65H 3/66; B65H 3/68

See application file for complete search history.

(56) References Cited

U.S. PATENT DOCUMENTS

| | | | | |
|---|---|---|---|---|
| 8,351,839 B2 * | 1/2013 | Matsumoto | ..... | B65H 5/36 399/361 |
| 8,505,913 B2 * | 8/2013 | Nishii | ..... | B65H 3/44 271/264 |

FOREIGN PATENT DOCUMENTS

| | | | |
|---|---|---|---|
| JP | 62-27268 | | 2/1987 |
| JP | 11157695 A | * | 6/1999 |
| JP | 2003192180 A | * | 7/2003 |
| JP | 2006193317 A | * | 7/2006 |

* cited by examiner

*Primary Examiner* — Luis A Gonzalez
(74) *Attorney, Agent, or Firm* — Gerald E. Hespos; Michael J. Porco; Matthew T. Hespos

(57) ABSTRACT

A sheet conveying device includes a sheet conveying path, a first conveying member, a first guide portion, a second guide portion, a registration roller pair, a third guide portion, and a guide member. A posture of the guide member is changeable between a first posture in which an upstream guide portion retracts from the sheet conveying path into a groove portion of the second guide portion, and a downstream guide portion projects to the sheet conveying path from the groove portion; and a second posture in which the downstream guide portion retracts from the sheet conveying path into the groove portion, and the upstream guide portion projects to the sheet conveying path from the groove portion.

17 Claims, 6 Drawing Sheets

SHEET CONVEYING DEVICE AND IMAGE FORMING APPARATUS PROVIDED WITH SAME

This application is based on Japanese Patent Application No. 2014-211385 filed on Oct. 16, 2014, the contents of which are hereby incorporated by reference.

BACKGROUND

The present disclosure relates to a sheet conveying device for conveying sheets, and an image forming apparatus incorporated with the sheet conveying device.

Conventionally, there is known a sheet conveying device disposed in a main body of an image forming apparatus, and configured to convey sheets. In the sheet conveying device, there is known a technique for correcting skew of a sheet being conveyed. Specifically, a curved guide that forms a sheet conveying path is pivotally moved in accordance with a skew amount of a sheet. According to the aforementioned technique, the conveying path length is changed at both ends of a sheet in the sheet width direction, and skew of the sheet is corrected.

SUMMARY

A sheet conveying device according to an aspect of the present disclosure includes a sheet conveying path along which a sheet is conveyed, a first conveying member, a first guide portion, a second guide portion, a registration roller pair, a third guide portion, and a guide member. The first conveying member conveys the sheet in the sheet conveying path. The first guide portion guides the sheet to be conveyed by the first conveying member in a predetermined conveying direction. The second guide portion includes a curved surface, and guides the sheet guided by the first guide portion along the curved surface. The second guide portion includes a groove portion formed in the curved surface along the conveying direction at a middle portion of the second guide portion in a sheet width direction intersecting with the conveying direction. The registration roller pair is disposed downstream of the second guide portion in the conveying direction of the sheet. The registration roller pair is configured to correct skew of the sheet by contact with a leading end of the sheet, and to convey the sheet. The third guide portion is disposed between the second guide portion and the registration roller pair. The third guide portion guides the sheet toward the registration roller pair. A guide member is disposed in the groove portion, and extends in the conveying direction along the curved surface. The guide member includes a pair of pivot portions, an upstream guide portion, and a downstream guide portion. The pair of pivot portions extends from both ends of the guide member in the sheet width direction, and is rotatably supported on the second guide portion. The upstream guide portion extends upstream of the pivot portions in the conveying direction. The downstream guide portion extends downstream of the pivot portions in the conveying direction. The guide member is pivotally movable around the pivot portions. The guide member is configured such that a posture of the guide member is changeable between a first posture in which the upstream guide portion retracts from the sheet conveying path into the groove portion, and the downstream guide portion projects to the sheet conveying path from the groove portion, and a second posture in which the downstream guide portion retracts from the sheet conveying path into the groove portion, and the upstream guide portion projects to the sheet conveying path from the groove portion. The guide member is set to the first posture when the leading end of the sheet to be conveyed by the first conveying member reaches the second guide portion. The posture of the guide member is changed from the first posture to the second posture when the leading end of the sheet passes through a downstream portion of the second guide portion in the conveying direction. The posture of the guide member is changed from the second posture to the first posture after the leading end of the sheet reaches the registration roller pair.

An image forming apparatus according to another aspect of the present disclosure includes the sheet conveying device having the aforementioned configuration, and an image forming assembly. The image forming assembly forms an image on the sheet conveyed by the registration roller pair, or forms an image on a sheet based on a document image of a document sheet conveyed by the registration roller pair.

These and other objects, features and advantages of the present disclosure will become more apparent upon reading the following detailed description along with the accompanying drawings.

DETAILED DESCRIPTION

Figure 1:
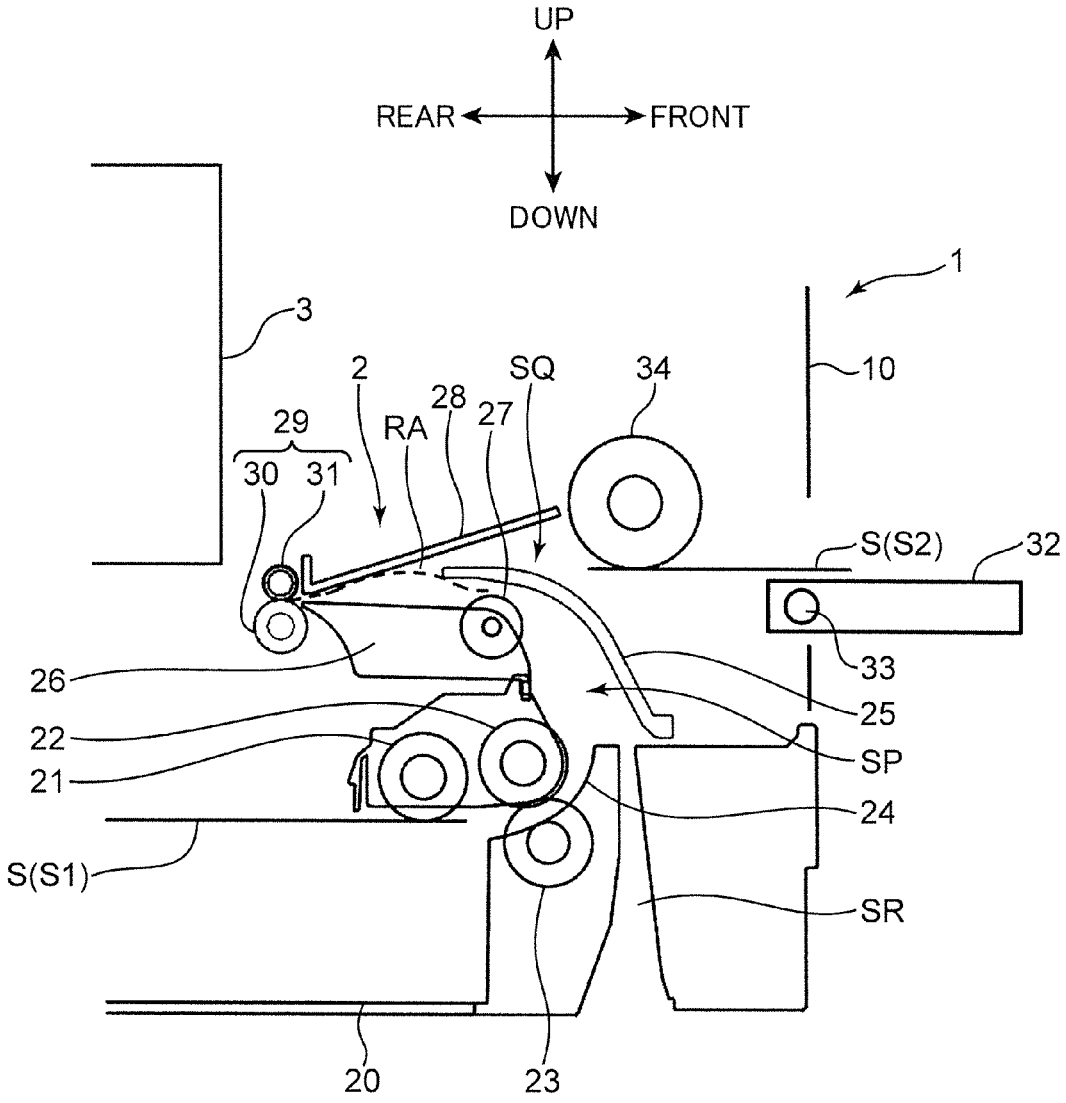
FIG. 1 is an enlarged sectional view of an image forming apparatus incorporated with a sheet conveying device as an embodiment of the present disclosure.

In the following, an embodiment of the present disclosure is described in details referring to the drawings. FIG. 1 is an enlarged sectional view of an image forming apparatus 1 embodying the present disclosure. The image forming apparatus 1 illustrated in FIG. 1 is a monochromatic printer. In another embodiment, the image forming apparatus may be a color printer, a facsimile machine, a complex machine provided with the functions of a color printer and a facsimile machine, or any other device for forming an image on a sheet. The terms representing the directions such as "UP", "DOWN", "FRONT", "REAR", "LEFT", and "RIGHT", which will be used in the following description, are used to clarify the description, and do not limit the principle of the image forming apparatus.

The image forming apparatus 1 is provided with an apparatus main body 10 for accommodating a variety of devices for forming an image on a sheet S (S1, S2). The image forming apparatus 1 is provided with a sheet feeding unit 2 (sheet conveying device) and an image forming assembly 3. The sheet feeding unit 2 conveys a sheet S toward the image forming assembly 3. The image forming assembly 3 forms an image on the sheet S conveyed from the sheet feeding unit 2. A well-known electrophotographic technology is applied to the image forming assembly 3. The image forming assembly 3 includes a photosensitive drum, a developing device, an exposure device, a transfer device, and a fixing device, all of which are not illustrated. A sheet S having an image formed thereon is discharged onto an unillustrated sheet discharge unit disposed on the upper surface portion of the apparatus main body 10. Any other image forming technology such as a well-known inkjet technology may be applied to the image forming assembly 3.

The sheet feeding unit 2 is provided with a sheet cassette 20 (sheet accommodating portion), a pickup roller 21, a sheet feeding roller 22 (first conveying member), and a retard roller 23.

The sheet cassette 20 accommodates a sheet S1 (first sheet) therein. The sheet cassette 20 is provided with an unillustrated lift plate. The lift plate causes the leading end of the sheet S1 to come into contact with the pickup roller 21. The sheet cassette 20 is allowed to be drawn forwardly with respect to the apparatus main body 10, and to be mounted rearwardly with respect to the apparatus main body 10. As illustrated in FIG. 1, a main conveying path SP (sheet conveying path) extends from the sheet cassette 20 to the image forming assembly 3 for conveying the sheet S1. In the sectional view illustrated in FIG. 1, the main conveying path SP has a substantially U shape.

The pickup roller 21 is disposed on the leading end of the sheet S1 that is lifted up by the lift plate. The pickup roller 21 is driven and rotated to feed the sheet S1 accommodated in the sheet cassette 20 forwardly. The sheet feeding roller 22 is disposed downstream of the pickup roller 21. The sheet feeding roller 22 is driven and rotated to feed (convey) the sheet S1 further downstream. The retard roller 23 is disposed to face the sheet feeding roller 22. The retard roller 23 has a function of separating sheets S1 fed by the pickup roller 21 one from another. In the embodiment, the retard roller 23 is rotatably supported on the sheet cassette 20.

The sheet feeding unit 2 is further provided with a sheet feeding guide 24 (first guide portion), a curved guide 25 (second guide portion), a lower guide 26, a driven roller 27, an upper guide (third guide portion), and a registration roller pair 29. The sheet feeding guide 24, the curved guide 25, the lower guide 26, and the upper guide 28 constitute a guide mechanism for guiding a sheet S1.

The sheet feeding guide 24 is disposed on the sheet cassette 20. The sheet feeding guide 24 is a curved surface portion, which is formed to face the sheet feeding roller 22. The sheet feeding guide 24 is formed to rise upward along the conveying direction of the sheet S1. The sheet feeding guide 24 guides the sheet S1 to be conveyed by the sheet feeding roller 22 upwardly (in a predetermined direction). The retard roller 23 is disposed at the middle portion of the sheet feeding guide 24 in the sheet width direction (left and right directions).

The curved guide 25 is disposed above the sheet feeding guide 24. The curved guide 25 includes a curved surface 25A (see FIG. 2A, FIG. 2B). The curved guide 25 guides the sheet S1 guided by the sheet feeding guide 24 horizontally (rearwardly) along the curved surface 25A. The curved guide 25 has such a shape that a plate-like member having a predetermined thickness is curved.

The lower guide 26 is disposed to face the curved guide 25. The lower guide 26 defines a part of the main conveying path SP in cooperation with the curved guide 25. Further, the lower guide 26 defines a part of the main conveying path SP in cooperation with the upper guide 28 at a position downstream of the curved guide 25 in the sheet conveying direction.

The driven roller 27 is rotatably supported at the front end of the lower guide 26. The driven roller 27 promotes conveyance of the sheet S1 in the main conveying path SP.

The upper guide 28 is disposed above the curved guide 25 and the lower guide 26. Further, the upper guide 28 is disposed between the curved guide 25 and the registration roller pair 29 for guiding the sheet S1 toward the registration roller pair 29. As illustrated in FIG. 1, the upstream portion of the upper guide 28 in the conveying direction is disposed above the downstream end of the curved guide 25 in the conveying direction. The upper guide 28 has an inclined shape. Specifically, the upper guide 28 is inclined downwardly toward the registration roller pair 29. The main conveying path SP is configured to be gradually narrowed toward the registration roller pair 29 by the slope of the upper guide 28.

The registration roller pair 29 is disposed downstream of the curved guide 25 in the conveying direction of the sheet S1. The registration roller pair 29 is constituted of a registration roller 30 and a driven roller 31. Causing the leading end of the sheet S1 to come into contact with the circumferential surface of the registration roller 30 in a state that rotation of the registration roller pair 29 is stopped makes it possible to correct skew of the sheet S1. Thus, the image forming position on the sheet S1 is adjusted. Further, the registration roller pair 29 is driven and rotated in synchronism with an image forming timing by the image forming assembly 3 for conveying the sheet S1 toward the image forming assembly 3.

As illustrated in FIG. 1, the curved guide 25 is disposed in such a manner as to cover the sheet feeding guide 24, the sheet feeding roller 22, and the driven roller 27 from above. Further, the lower guide 26 defines the rear portion of a vertically extending region of the main conveying path SP at a position upstream of the driven roller 27 in the conveying direction. Further, the lower guide 26 defines the lower portion of a horizontally extending region of the main conveying path SP to the registration roller pair 29 at a position downstream of the driven roller 27 in the conveying direction.

The sheet feeding unit 2 is further provided with a manual feed tray 32 (sheet placing portion), a tray pivot portion 33, a manual feed conveying path SQ, and a feeding roller 34 (second conveying member).

The manual feed tray 32 is pivotally mounted on the front wall portion of the apparatus main body 10. A sheet S2 (second sheet) is placed on the manual feed tray 32. The tray pivot portion 33 is a pivot around which the manual feed tray 32 is pivotally moved. The manual feed conveying path SQ is a conveying path along which the sheet S2 is to be conveyed. The manual feed conveying path SQ communicates with the downstream portion of the main conveying path SP in the conveying direction. The feeding roller 34 is disposed on the rear side of the manual feed tray 32, and on the front side of the upper guide 28. The feeding roller 34 is driven and rotated to convey the sheet S2 toward the registration roller pair 29 while passing the sheet S2 between the upper guide 28 and the downstream end of the curved guide 25 in the conveying direction.

When another sheet cassette is mounted beneath the sheet cassette 20, a sheet dispensed from the other sheet cassette is conveyed to the main conveying path SP via a communication conveying path SR formed in the sheet cassette 20.

As described above, a sheet S1 dispensed from the sheet cassette 20 by the pickup roller 21 and the sheet feeding roller 22 is conveyed to the main conveying path SP while making a U-turn. Specifically, after a sheet S1 is guided upwardly by the sheet feeding guide 24, the sheet S1 is guided rearwardly by the curved guide 25 and the driven roller 27 while keeping firm contact with the curved guide 25. The leading end of the sheet S1 is transferred from the downstream end of the curved guide 25 in the conveying direction to the upper guide 28. The leading end of the sheet S1 reaches a nip portion of the registration roller pair 29, while being guided by the upper guide 28, and conveyance of the sheet S1 is stopped at the nip portion. Thereafter, the trailing end of the sheet S1 is continued to be conveyed by the sheet feeding roller 22. As a result of the aforementioned operation, a loop is formed at the leading end of the sheet S1 as illustrated by the broken line in FIG. 1. In order to form the aforementioned loop, the distance from the sheet feeding roller 22 to the registration roller pair 29 along the conveying direction of the sheet S1 is set to be shorter than the length of the sheet S1 in the conveying direction. When another conveying roller to be driven and rotated is disposed between the sheet feeding roller 22 and the registration roller pair 29, the distance from the conveying roller to the registration roller pair 29 may be set shorter than the length of the sheet S1.

As illustrated in FIG. 1, in the embodiment, the downstream portion of the curved guide 25 in the conveying direction substantially horizontally extends downstream of the driven roller 27 in the conveying direction. According to this configuration, the leading end of the sheet S1 that has left the downstream end of the curved guide 25 in the conveying direction comes into contact with the upper guide 28 at a small angle. This makes it possible to reduce the load to the sheet S1. In other words, when the downstream end of the curved guide 25 in the conveying direction is disposed upstream of the driven roller 27 in the conveying direction, the sheet S1 comes into contact with the upper guide 28 at a large angle.

On the other hand, as described above, when the downstream end of the curved guide 25 in the conveying direction is disposed at a position near the registration roller pair 29, a loop forming portion RA (see FIG. 1) where a loop is formed at the leading end of the sheet S1 becomes small. In this case, the loop of the sheet S1 to be formed becomes also small. This may reduce the effect of correcting skew of the sheet S1. Increasing the conveying performance of the sheet feeding roller 22 may increase the skew correcting effect of the sheet S1. In this case, however, the leading end of the sheet S1 is likely to pass through the nip portion of the registration roller pair 29 without being nipped. Further, increasing the nip pressure of the registration roller pair 29 in an attempt to prevent the sheet S1 from passing through the nip portion without being nipped may increase the driving load of the registration roller 30. This requires a driving motor provided with a high output torque. In any case, the cost of the sheet feeding unit 2 and the image forming apparatus 1 may increase. As described above, when the region of the main conveying path SP from the sheet cassette 20 to the registration roller pair 29 has a U-shape, it is required to precisely correct skew of the sheet S1, while reducing the load exerted on the leading end of the sheet S1. It is desirable to solve the aforementioned drawback with a simplified configuration in order to prevent oversizing of the sheet feeding unit 2.

Figure 2A:
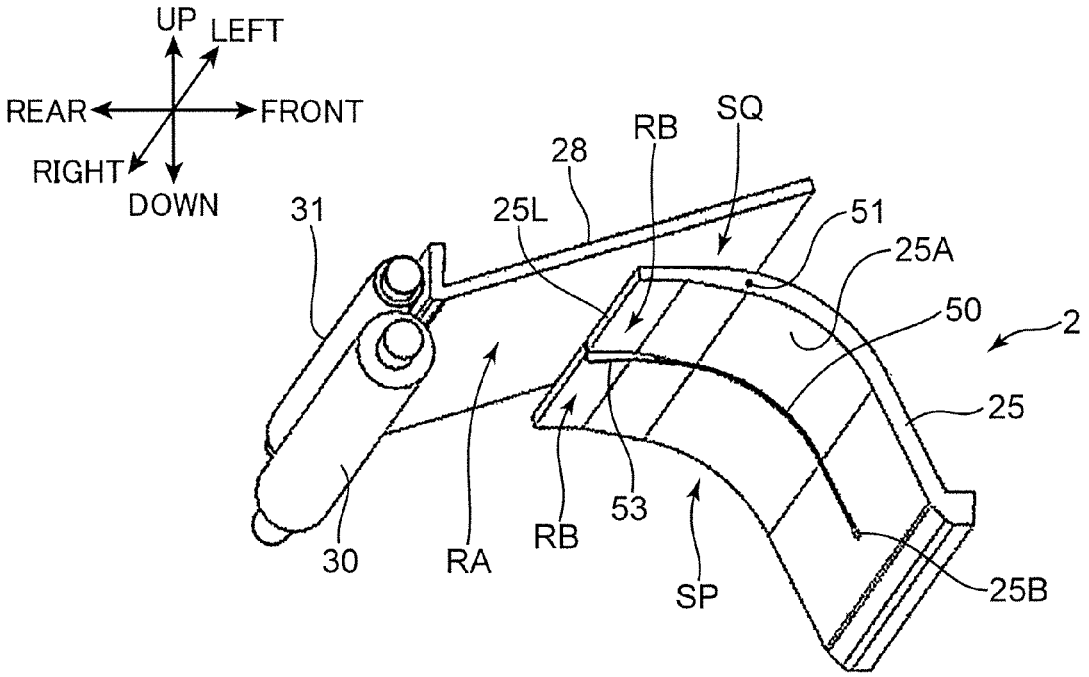
FIG. 2A and FIG. 2B are perspective views illustrating a part of the sheet conveying device as the embodiment of the present disclosure.
Figure 2B:
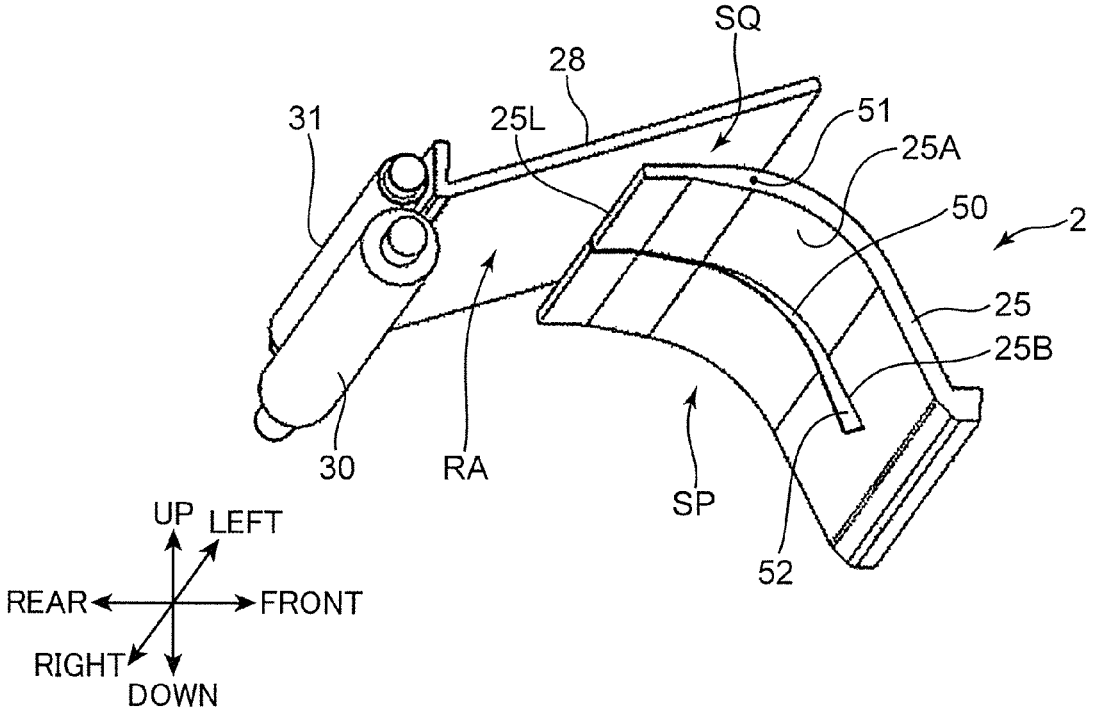
Figure 3A:
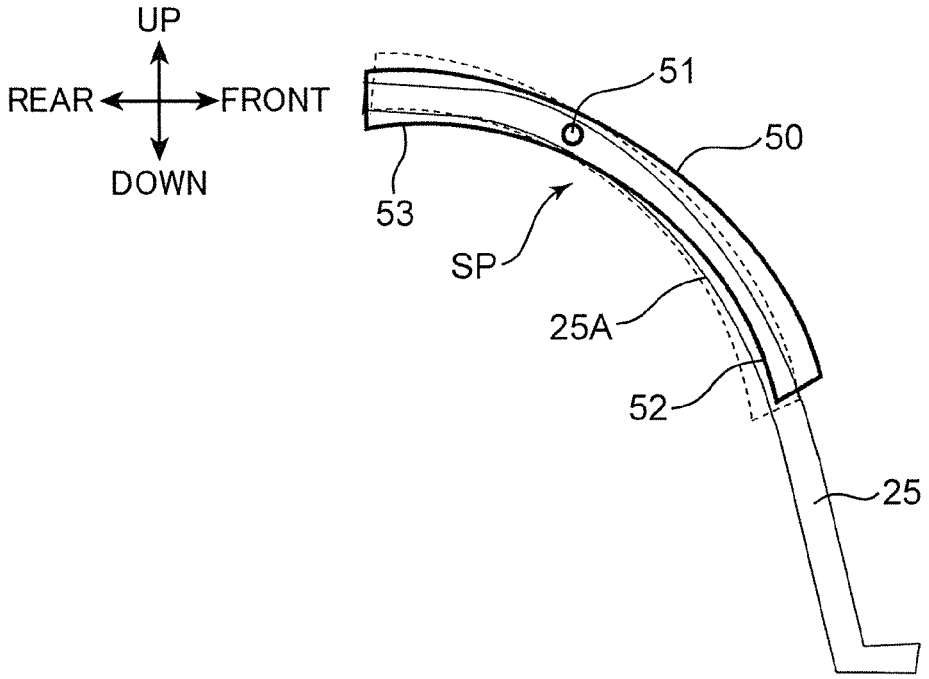
FIG. 3A and FIG. 3B are sectional views illustrating postures of a guide member in the embodiment of the present disclosure.
Figure 3B:
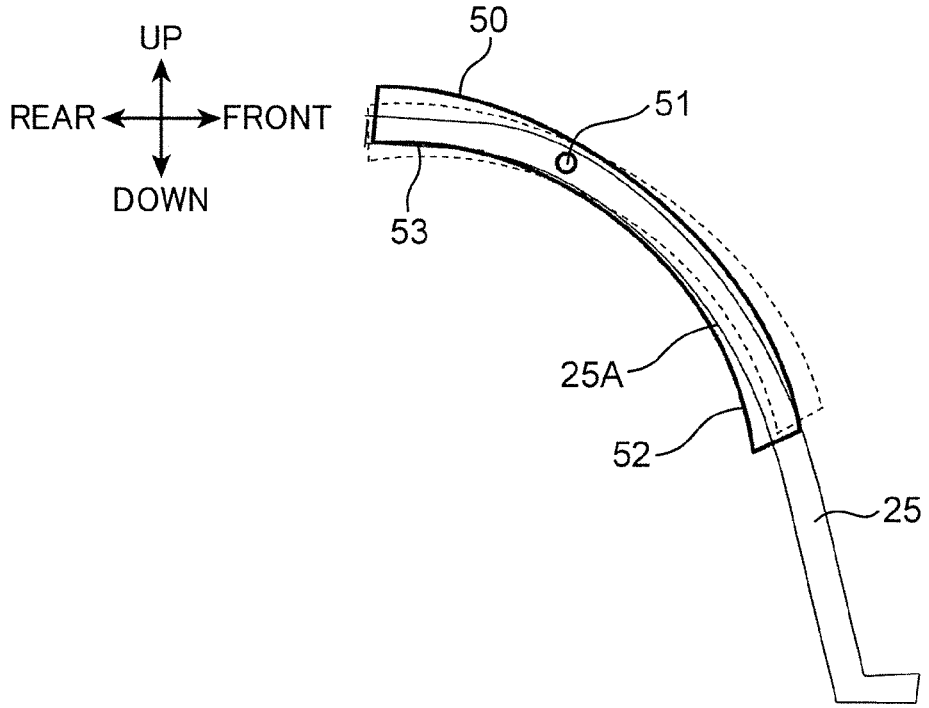
Figure 4:
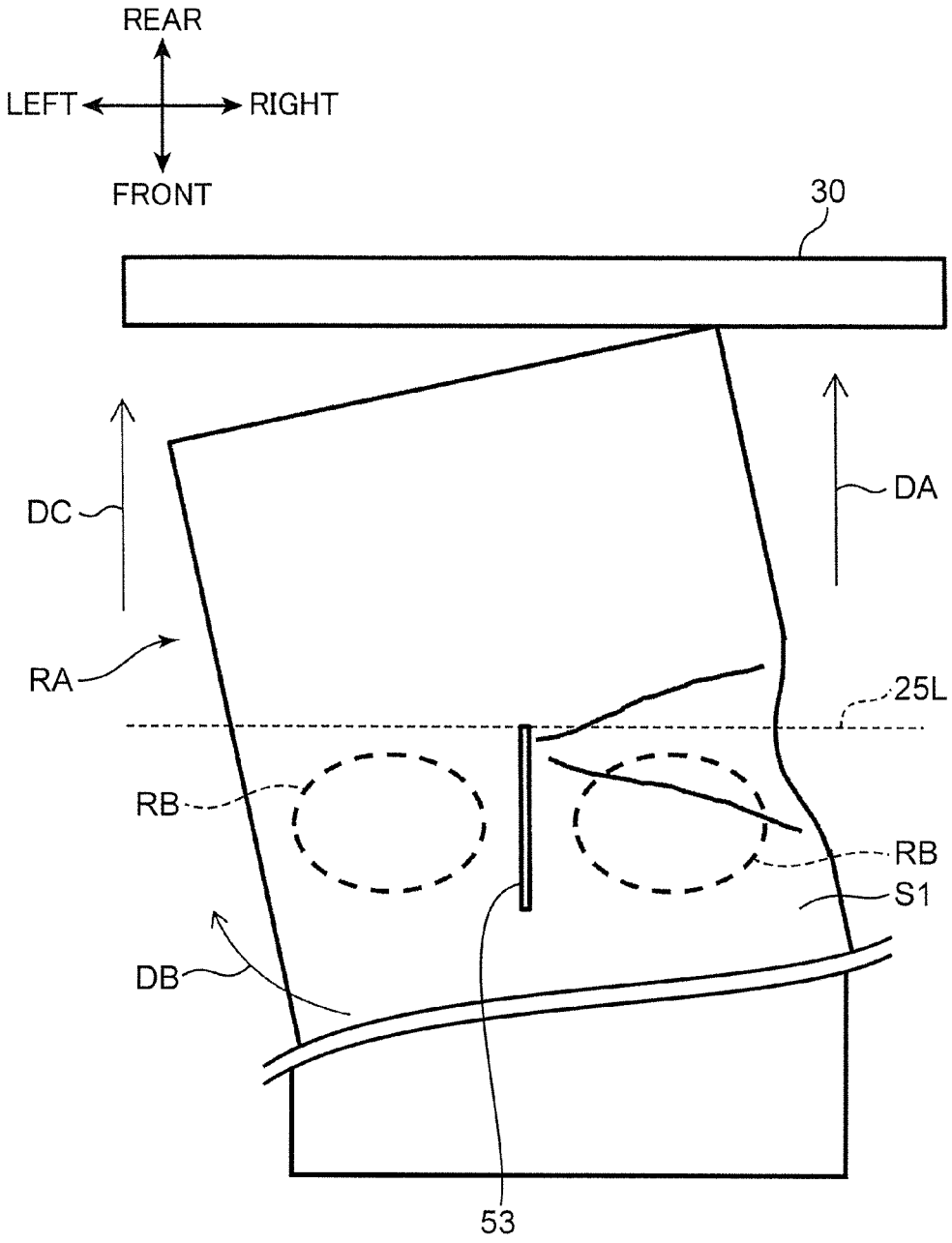
FIG. 4 is a schematic top plan view illustrating a manner as to how skew of a sheet is corrected in the sheet conveying device as the embodiment of the present disclosure.

In view of the aforementioned drawback, in the embodiment, the sheet feeding unit 2 is provided with a movable guide rib 50 (guide member). FIG. 2A and FIG. 2B are perspective views illustrating a part of the sheet feeding unit 2 in the embodiment. FIG. 3A and FIG. 3B are sectional views illustrating postures of the movable guide rib 50 in the embodiment. FIG. 4 is a schematic top plan view illustrating a manner as to how skew of the sheet S1 is corrected in the sheet feeding unit 2. Referring to FIG. 2A, the curved guide 25 is provided with a groove portion 25B. The groove portion 25B is a groove formed in the curved surface 25A along the conveying direction of the sheet S1 at the middle portion of the curved guide 25 in the sheet width direction (left and right directions) intersecting with the conveying direction of the sheet S1. The groove portion 25B is formed to extend in the conveying direction of the sheet S1 with a predetermined width in the sheet width direction.

The movable guide rib 50 is disposed in the groove portion 25B in such a manner as to extend in the conveying direction of the sheet S1 along the curved surface 25A. The movable guide rib 50 is a plate-like member having an arc shape. The movable guide rib 50 is provided with a lateral end which comes into contact with the sheet surface of the sheet S1, and is curved along the curved surface 25A. The movable guide rib 50 is provided with a pair of guide pivot portions 51 (pivot portions), an inlet guide 52 (upstream guide portion), and an outlet guide 53 (downstream guide portion).

The pair of guide pivot portions 51 (see FIG. 2A, FIG. 3A) is a rod portion extending from both ends of the movable guide rib 50 in the sheet width direction. The guide pivot portion 51 is rotatably supported on the curved guide 25. The inlet guide 52 is a part of the movable guide rib 50 extending upstream of the guide pivot portion 51 in the conveying direction. The outlet guide 53 is a part of the movable guide rib 50 extending downstream of the guide pivot portion 51 in the conveying direction. As illustrated in FIG. 2A, the downstream end of the outlet guide 53 in the conveying direction is disposed in the vicinity of the downstream end (guide tip end 25L) of the curved guide 25 in the conveying direction. The movable guide rib 50 is pivotally movable around the guide pivot portion 51.

The movable guide rib 50 is configured such that the posture of the movable guide rib 50 is changeable between a first posture (see FIG. 2A, FIG. 3A) and a second posture (see FIG. 2B, FIG. 3B). When the movable guide rib 50 is in the first posture, the inlet guide 52 of the movable guide rib 50 retracts from the main conveying path SP into the groove portion 25B, and the outlet guide 53 projects to the main conveying path SP (below the main conveying path SP) from the groove portion 25B. Further, when the movable guide rib 50 is in the second posture, the outlet guide 53 of the movable guide rib 50 retracts from the main conveying path SP into the groove portion 25B, and the inlet guide 52 projects to the main conveying path SP (leftwardly) from the groove portion 25B. The movable guide rib 50 is set to the first posture when the leading end of the sheet S1 to be conveyed by the sheet feeding roller 22 reaches the curved guide 25. Further, the posture of the movable guide rib 50 is changed from the first posture to the second posture when the leading end of the sheet S1 passes through the downstream portion of the curved guide 25 in the conveying direction. Then, the posture of the movable guide rib 50 is changed from the second posture to the first posture after the leading end of the sheet S1 reaches the registration roller pair 29. In the embodiment, when an external force is not exerted to the movable guide rib 50, the movable guide rib 50 is set to the first posture by the moment of rotation around the guide pivot portion 51, which is generated by the weight of the movable guide rib 50. Thus, it is possible to set the basic posture of the movable guide rib 50 to the first posture by the position of the centroid of the movable guide rib 50.

When the sheet S1 is conveyed by the sheet feeding roller 22, and is guided upwardly by the sheet feeding guide 24 (see FIG. 1), the upstream portion of the curved guide 25 in the conveying direction becomes flat along the sheet width direction. According to this configuration, the leading end of the sheet S1 is stably guided by the curved guide 25 without interference with the upstream end of the movable guide rib 50. Thereafter, when the leading end of the sheet S1 reaches the downstream portion of the curved guide 25 in the conveying direction, the outlet guide 53 of the movable guide rib 50 in the first posture is pressed upwardly by the sheet S1. As a result of the aforementioned operation, the movable guide rib 50 is pivotally moved around the guide pivot portion 51, and the posture of the movable guide rib 50 is changed to the second posture (see FIG. 2B, FIG. 3B). When the movable guide rib 50 is set to the second posture, the downstream portion of the curved guide 25 in the conveying direction becomes flat along the sheet width direction. According to this configuration, it is possible to stably transfer the leading end of the sheet S1 from the curved guide 25 to the upper guide 28.

Further, when the leading end of the sheet S1 reaches the registration roller pair 29, and conveyance of the sheet S1 is stopped at the registration roller pair 29, the leading end of the sheet S1 starts to curve in the loop forming portion RA. The loop forming portion RA includes a step portion between the curved guide 25 and the upper guide 28. When the leading end of the sheet S1 starts to curve in the loop forming portion RA, the sheet surface of the sheet S1 presses the inlet guide 52 of the curved guide 25 forward, and comes into firm contact with the curved surface 25A. As a result of the aforementioned operation, the movable guide rib 50 is pivotally moved around the guide pivot portion 51, and the posture of the movable guide rib 50 is changed to the first posture (see FIG. 2A, FIG. 3A).

When the aforementioned operation is performed, the sheet surface of the sheet S1 leaves away from the curved surface 25A below the curved surface 25A on the downstream portion of the curved guide 25 in the conveying direction, and a space is formed below the curved surface 25A, because the outlet guide 53 protrudes downwardly from the curved surface 25A. As a result of the aforementioned operation, referring to FIG. 2A and FIG. 4, auxiliary loop forming portions RB, each of which communicates with the loop forming portion RA are formed on both ends of the outlet guide 53 in the sheet width direction. The aforementioned configuration makes it possible to form a loop of the sheet S1 in such a manner that the loop extends widely toward upstream in the conveying direction, as compared with the loop of the sheet S1 illustrated by the broken line in FIG.

Referring to FIG. 4, when the right portion of the leading end of the sheet S1 reaches the registration roller 30 earlier due to skew of the sheet S1 (see the arrow DA in FIG. 4), it is possible to form a loop of the sheet S1 by using the loop forming portion RA and the right-side auxiliary loop forming portion RB. In the embodiment, the distance from the sheet feeding roller 22 (see FIG. 1) to the registration roller pair 29 along the conveying direction is shorter than the length of the sheet S1 in the conveying direction. Therefore, it is possible to form a loop of the sheet S1 by the conveyance force of the sheet feeding roller 22. Then, the trailing end of the sheet S1 turns as illustrated by the arrow DB in FIG. 4 by the conveyance force of the sheet feeding roller 22. Then, the left portion of the leading end of the sheet S1 reaches the registration roller 30 later (see the arrow DC in FIG. 4). Thus, skew of the sheet S1 is corrected.

In this way, in the embodiment, projecting the outlet guide 53 from the curved surface 25A makes it possible to press the sheet surface of a sheet by the outlet guide 53, thereby causing the sheet surface to be away from the curved surface 25A. This makes it possible to increase the degree of freedom of turning (twisting) the sheet S1. This is advantageous in forming a loop of the sheet S1 and in correcting skew of the sheet S1. Further, as the movable guide rib 50 is pivotally moved, the outlet guide 53 is allowed to be retracted from the curved surface 25A above the curved surface 25A. This makes it possible to increase the projection height of the outlet guide 53 with respect to the curved surface 25A at the time of projection (when the movable guide rib 50 is set to the first posture). This makes it possible to increase the auxiliary loop forming portions RB in up and down directions and in front and rear directions. The trailing end of the sheet S1 in the conveying direction is held by a nip portion between the sheet feeding roller 22 (see FIG. 1) and the retard roller 23 (see FIG. 1). Therefore, as illustrated in FIG. 4, the trailing end of the sheet S1 in the conveying direction does not turn (is not twisted). As described above, a loop is formed at the leading end of the sheet S1 in the conveying direction. Further, in the embodiment, it is possible to stably correct skew of a sheet by the movable guide rib 50 having a simplified configuration such that the movable guide rib 50 is constituted of a plate-like member having an arc shape.

Further, in the embodiment, the movable guide rib 50 is pivotally moved by using the pressing force of the sheet S1. This makes it possible to form a space for skew correction of the sheet S1. Therefore, even when the conveyance speed or the loop amount of the sheet S1 varies depending on the type of the sheet or a change in the ambient environment, it is possible to stably correct skew of the sheet S1. When skew of the sheet S1 is corrected, a loop forming area for the sheet S1 is secured by the loop forming portion RA and the auxiliary loop forming portions RB. Therefore, even when the sheet S1 is strongly pressed toward the registration roller pair 29 by the sheet feeding roller 22, it is possible to prevent skew of the sheet S1, whose skew is temporarily corrected.

Further, in the embodiment, the loop forming portion RA and the auxiliary loop forming portions RB are provided. Therefore, it is not necessary to strongly press the sheet S1 toward the registration roller pair 29 by the sheet feeding roller 22 for forming a loop. This makes it possible to prevent the leading end of the sheet S1 from passing through the nip portion of the registration roller pair 29 without being nipped. Further, this makes it possible to reduce the need of connecting a driving motor having a high rotating torque to the registration roller pair 29 in order to increase the nip pressure of the nip portion for the purpose of preventing the sheet S1 from passing through the nip portion without being nipped as described above.

Further, in the embodiment, as described above, a sheet S2 placed on the manual feed tray 32 is conveyed toward the registration roller pair 29 while passing between the upper guide 28 and the guide tip end 25L of the curved guide 25 by the feeding roller 34. When the leading end of the sheet S2 comes into contact with the registration roller pair 29, and conveyance of the sheet S2 is stopped at the registration roller pair 29, a loop is formed at the leading end of the sheet S2 by the conveyance force of the feeding roller 34. When the loop is formed, the sheet S2 forms a downwardly drooping loop (having a shape such that the broken-line shape illustrated in FIG. 1 is upside down) at a position between the registration roller pair 29 and the guide tip end 25L of the curved guide 25. As a result of the aforementioned operation, skew of the sheet S2 is corrected. As described above, in the embodiment, it is possible to correct skew of the sheet S1 and the sheet S2, using the downstream portion of the curved guide 25 in the conveying direction, which serves as a merging portion of the main conveying path SP and the manual feed conveying path SQ.

The sheet feeding unit 2 and the image forming apparatus 1 incorporated with the sheet feeding unit 2 embodying the present disclosure are described as above. The present disclosure, however, is not limited to the above. For instance, the following modified embodiments may be applicable.

(1) In the embodiment, the movable guide rib 50 is set to the first posture by the moment of rotation around the guide pivot portion 51, which is generated by the weight of the movable guide rib 50. The present disclosure, however, is not limited to the above. An unillustrated coil spring (biasing member) may be disposed at the guide pivot portion 51. In this case, the coil spring biases the movable guide rib 50 around the guide pivot portion 51 in such a manner that the movable guide rib 50 is set to the first posture. Specifically, referring to FIG. 3A, the biasing member biases the movable guide rib 50 counterclockwise around the guide pivot portion 51.

Figure 5:
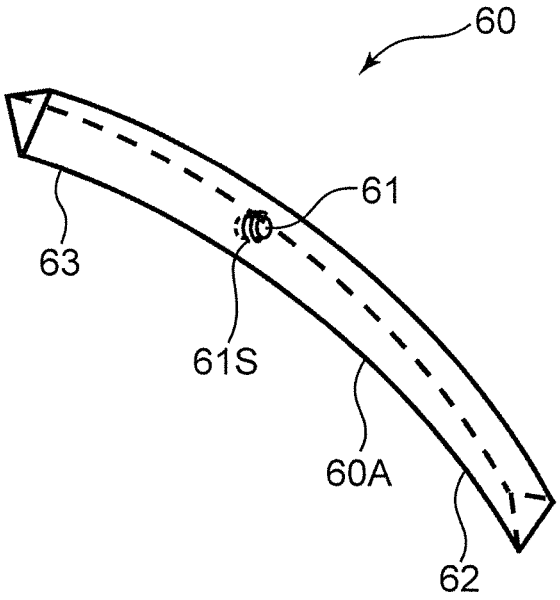
FIG. 5 is a perspective view of a guide member in a modified embodiment of the present disclosure.

(2) Further, in the embodiment, the movable guide rib 50 is constituted of a plate-like member. The present disclosure, however, is not limited to the above. FIG. 5 is a perspective view of a movable guide 60 (guide member) in a modified embodiment of the present disclosure. The movable guide 60 is provided with a ridge 60A which comes into contact with a sheet surface of a sheet S1. The movable guide 60 is a triangular prismatic member, which is curved along a curved surface 25A (see FIG. 2A). The movable guide 60 is further provided with an inlet guide 62 (upstream guide portion) and an outlet guide 63 (downstream guide portion). The movable guide 60 is pivotally movable around a guide pivot portion 61. The guide pivot portion 61 is provided with a biasing spring 61S (biasing member). The biasing spring 61S biases the movable guide 60 around the guide pivot portion 61 so that the movable guide 60 is set to the first posture. According to this configuration, as well as the embodiment, projecting the outlet guide 63 below a groove portion 25B (see FIG. 2A) makes it possible to form auxiliary loop forming portions RB, each of which communicates with a loop forming portion RA (see FIG. 2A). The aforementioned configuration makes it possible to form a loop of the sheet S1 in such a manner that the loop extends widely toward upstream in the conveying direction, as compared with the loop of the sheet S1 illustrated by the broken line in FIG. 1. Further, the movable guide 60 having a triangular prismatic shape makes it possible to stably press the sheet surface of the sheet S1. This makes it possible to stably correct skew of the sheet S1. Further, the biasing force of the biasing spring 61S makes it possible to stably set the basic posture of the movable guide 60 to the first posture. As well as the embodiment, the movable guide 60 may be set to the first posture by the moment of rotation around the guide pivot portion 61, which is generated by the weight of the movable guide 60.

(3) Further, in the embodiment, the upstream portion of the main conveying path SP has a U-shape. The present disclosure, however, is not limited to the above. The present disclosure is also applicable to another conveying path configured such that a sheet S1 is guided upwardly, and thereafter, reaches the registration roller pair 29 while being horizontally guided by the curved guide 25.

Figure 6:
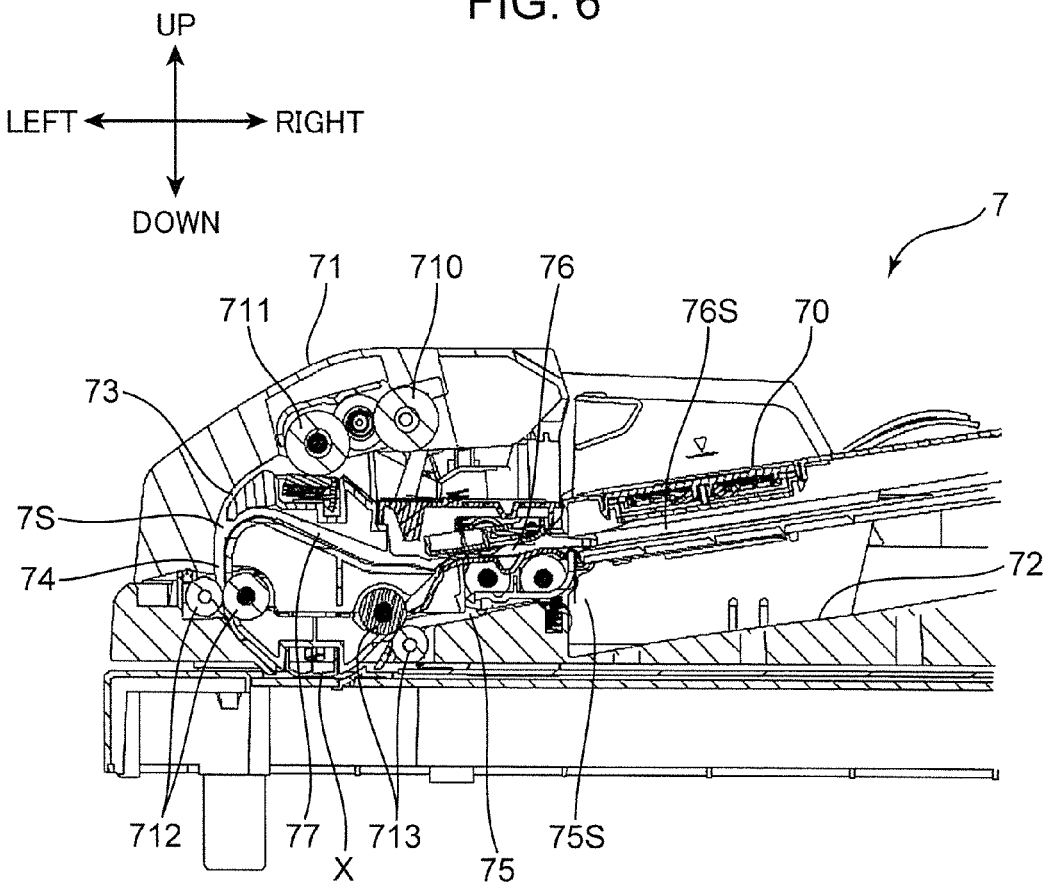
FIG. 6 is a sectional view of a sheet conveying device as a modified embodiment of the present disclosure.

(4) Further, in the embodiment, the sheet conveying device is described by using the sheet feeding unit 2. The present disclosure, however, is not limited to the above. FIG. 6 is a sectional view of a sheet conveying device as a modified embodiment of the present disclosure. In the modified embodiment, an automatic document conveying device 7 is applied as the sheet conveying device. The automatic document conveying device 7 conveys a document sheet as a sheet to a document reading position X. The automatic document conveying device 7 is provided with a document placing tray 70, a document conveying portion 71, and a document discharge tray 72. The automatic document conveying device 7 is further provided with a first conveying path 73, a second conveying path 74, a third conveying path 75, a switchback conveying path 76, an intermediate conveying path 77, and a path merging portion 7S. The automatic document conveying device 7 is further provided with a pickup roller 710, a sheet feeding roller 711 (first conveying member), a registration roller pair 712, and an intermediate conveying roller 713.

A stack of document sheets are placed on the document placing tray 70. The document conveying portion 71 conveys the document sheets stacked on the document placing tray 70 one by one so that each one of the document sheets passes through the document reading position X, and then, discharges the document sheets onto the document discharge tray 72. An unillustrated document reading portion is disposed to face the document reading position X.

Each one of the document sheets placed on the document placing tray 70 is conveyed to the first conveying path 73 by the pickup roller 710 and the sheet feeding roller 711. Further, each one of the document sheets passes through the document reading position X, while being conveyed downwardly along the second conveying path 74 by the registration roller pair 712, and is discharged onto the document discharge tray 72 through a discharge port 75S by the intermediate conveying roller 713.

When a document image is formed on both sides of a document sheet, the document sheet is conveyed to the switchback conveying path 76 by the intermediate conveying roller 713, using an unillustrated convey changeover unit. After the document sheet is switched back on an intermediate tray 76S, the document sheet is conveyed from the intermediate conveying path 77 to the second conveying path 74. Then, the document sheet is conveyed toward the document reading position X by the registration roller pair 712.

In the modified embodiment, as well as the embodiment, it is possible to apply a first guide portion, a second guide portion, and a third guide portion to the path merging portion 7S where the intermediate conveying path 77 and the first conveying path 73 are merged together. According to this configuration, a loop of a document sheet is formed in the vicinity of the path merging portion 7S, and a document image is stably read in a state that skew of the document sheet is corrected.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet conveying device, comprising:

a sheet conveying path along which a sheet is conveyed;

a first conveying member which conveys the sheet in the sheet conveying path;

a first guide portion which guides the sheet to be conveyed by the first conveying member in a predetermined conveying direction;

a second guide portion including a curved surface, and configured to guide the sheet guided by the first guide portion along the curved surface, the second guide portion further including a groove portion formed in the curved surface along the conveying direction at a middle portion of the second guide portion in a sheet width direction intersecting with the conveying direction;

a registration roller pair disposed downstream of the second guide portion in the conveying direction of the sheet, the registration roller pair being configured to correct skew of the sheet by contact with a leading end of the sheet, and to convey the sheet;

a third guide portion disposed between the second guide portion and the registration roller pair, and configured to guide the sheet toward the registration roller pair; and a guide member disposed in the groove portion, and extending in the conveying direction along the curved surface, wherein the guide member includes:

a pair of pivot portions extending from both ends of the guide member in the sheet width direction, and configured to be rotatably supported on the second guide portion;

an upstream guide portion extending upstream of the pivot portions in the conveying direction to an upstream end, the upstream end being spaced from the pivot portions by a first length; and a downstream guide portion extending downstream of the pivot portions in the conveying direction to a downstream end, the downstream end being spaced from the pivot portions by a second length that is less than the first length, the guide member is pivotally movable around the pivot portions, a posture of the guide member is changeable between a first posture in which the upstream guide portion retracts from the sheet conveying path into the groove portion, and the downstream guide portion projects to the sheet conveying path from the groove portion, and a second posture in which the downstream guide portion retracts from the sheet conveying path into the groove portion, and the upstream guide portion projects to the sheet conveying path from the groove portion, the guide member is set to the first posture when the leading end of the sheet to be conveyed by the first conveying member reaches the second guide portion, the posture of the guide member is changed from the first posture to the second posture when the leading end of the sheet passes through a downstream portion of the second guide portion in the conveying direction, and the posture of the guide member is changed from the second posture to the first posture after the leading end of the sheet reaches the registration roller pair.

2. The sheet conveying device according to claim 1, wherein the posture of the guide member is changed to the second posture when the downstream guide portion in the first posture is pressed by the sheet and is pivotally moved around the pivot portions.

3. The sheet conveying device according to claim 1, wherein a downstream end of the downstream guide portion of the guide member in the conveying direction is disposed in a vicinity of the downstream end of the second guide portion in the conveying direction.

4. The sheet conveying device according to claim 1, wherein a distance from the first conveying member to the registration roller pair along the conveying direction is shorter than a length of the sheet in the conveying direction.

5. The sheet conveying device according to claim 1, wherein the guide member is provided with a lateral end which comes into contact with a sheet surface of the sheet, the guide member being a plate-like member having an arc shape curved along the curved surface.

6. The sheet conveying device according to claim 1, wherein the guide member is provided with a ridge which comes into contact with a sheet surface of the sheet, the guide member having a triangular prismatic shape curved along the curved surface.

7. The sheet conveying device according to claim 1, wherein the guide member is set to the first posture by a moment of rotation around the pivot portions, the moment of rotation being generated by the weight of the guide member.

8. The sheet conveying device according to claim 1, further comprising:

a biasing member which biases the guide member around the pivot portions in such a manner that the guide member is set to the first posture.

9. The sheet conveying device according to claim 1, further comprising:

a sheet accommodating portion in which a first sheet as the sheet is accommodated;

a sheet placing portion on which a second sheet is placed; and a second conveying member which conveys the second sheet placed on the sheet placing portion toward the registration roller pair while passing the second sheet between the third guide portion and the downstream end of the second guide portion in the conveying direction, wherein the first conveying member feeds the first sheet from the sheet accommodating portion.

10. An image forming apparatus, comprising:

the sheet conveying device of claim 1; and an image forming assembly which forms an image on the sheet conveyed by the registration roller pair, or forms an image on a sheet based on a document image of a document sheet conveyed by the registration roller pair.

11. A sheet conveying device, comprising:

a sheet conveying path along which a sheet is conveyed;

a first conveying member that conveys the sheet in the sheet conveying path;

a first guide portion that guides the sheet to be conveyed by the first conveying member in a predetermined conveying direction;

a second guide portion including a curved surface, and configured to guide the sheet guided by the first guide portion along the curved surface, the second guide portion further including a groove formed in the curved surface along the conveying direction at a middle portion of the second guide portion in a sheet width direction intersecting with the conveying direction;

a registration roller pair disposed downstream of the second guide portion in the conveying direction of the sheet, the registration roller pair being configured to correct skew of the sheet by contact with a leading end of the sheet, and to convey the sheet;

a third guide portion disposed between the second guide portion and the registration roller pair, and configured to guide the sheet toward the registration roller pair; and a guide member disposed in the groove of the second guide portion and curved along the conveying direction, the guide member defining an elongate triangular prismatic shape with a ridge extending in the conveying direction and two inclined surfaces extending from the ridge and inclined relative to the curved surface, two pivot portions extending respectively from opposite sides of the guide member and projecting in the sheet width direction, the guide member defining an upstream guide portion extending upstream of the pivot portions in the conveying direction and a downstream guide portion extending downstream of the pivot portions in the conveying direction, the pivot portions pivotally supporting the guide member on the second guide portion, a posture of the guide member being pivotable relative to the second guide portion between a first posture in which the upstream guide portion retracts from the sheet conveying path into the groove while the ridge along the downstream guide portion projects from the groove and into the sheet conveying path for contacting a surface of the sheet, and a second posture in which the downstream guide portion retracts from the sheet conveying path into the groove while the ridge along the upstream guide portion projects from the groove and into the sheet conveying path for contacting the surface of the sheet, wherein:

the guide member is set to the first posture when the leading end of the sheet to be conveyed by the first conveying member reaches the second guide portion, the posture of the guide member is changed from the first posture to the second posture when the leading end of the sheet passes through a downstream portion of the second guide portion in the conveying direction, and the posture of the guide member is changed from the second posture to the first posture after the leading end of the sheet reaches the registration roller pair.

12. The sheet conveying device according to claim 11, wherein the posture of the guide member is changed to the second posture when the downstream guide portion in the first posture is pressed by the sheet and is pivotally moved around the pivot portions.

13. The sheet conveying device according to claim 11, wherein a downstream end of the downstream guide portion of the guide member in the conveying direction is disposed in a vicinity of the downstream end of the second guide portion in the conveying direction.

14. The sheet conveying device according to claim 11, wherein a distance from the first conveying member to the registration roller pair along the conveying direction is shorter than a length of the sheet in the conveying direction.

15. The sheet conveying device according to claim 11, wherein the guide member is set to the first posture by a moment of rotation around the pivot portions, the moment of rotation being generated by the weight of the guide member.

16. The sheet conveying device according to claim 11, further comprising:

a biasing member which biases the guide member around the pivot portions in such a manner that the guide member is set to the first posture.

17. An image forming apparatus, comprising:

the sheet conveying device of claim 11; and an image forming assembly that forms an image on the sheet conveyed by the registration roller pair, or forms an image on a sheet based on a document image of a document sheet conveyed by the registration roller pair.

* * * * *